United States Patent [19]

Schott et al.

[11] Patent Number: 4,860,905

[45] Date of Patent: Aug. 29, 1989

[54] DISPLAY AND METHOD OF FORMING

[75] Inventors: David B. Schott, Cuyahoga Falls; Danny J. Kump, Mayfield; Gerald A. Conway, Cleveland, all of Ohio

[73] Assignee: Gerald Conway & Company, Cleveland, Ohio

[21] Appl. No.: 303,198

[22] Filed: Jan. 30, 1989

[51] Int. Cl.[4] ..... A47F 5/08

[52] U.S. Cl. ..... 211/59.1; 248/220.3; 248/222.3

[58] Field of Search ..... 211/59.1, 57.1; 248/222.3, 222.4, 220.2, 220.3, 222.2

[56] References Cited

U.S. PATENT DOCUMENTS

| | | | |
|---|---|---|---|
| 3,180,606 | 4/1965 | Sabin et al. | 248/222.3 X |
| 3,628,762 | 12/1971 | Williams | 248/222.2 X |
| 3,912,221 | 10/1975 | Betts | 248/220.3 |
| 3,944,176 | 3/1976 | Danko | 248/220.3 X |
| 4,103,854 | 8/1978 | Pliml et al. | 248/222.2 X |
| 4,671,417 | 6/1987 | O'Brien | 248/220.3 X |

FOREIGN PATENT DOCUMENTS

| | | | |
|---|---|---|---|
| 1112265 | 8/1961 | Fed. Rep. of Germany | 248/222.3 |
| 586639 | 3/1925 | France | 248/222.3 |
| 1200778 | 12/1959 | France | 248/222.2 |

*Primary Examiner*—Robert W. Gibson, Jr.

*Attorney, Agent, or Firm*—Renner, Otto, Boisselle & Sklar

[57] ABSTRACT

A display for point of purchase items or packages includes a panel such as carboard with one or more vertical rectangular slots with display hooks for supporting such items or packages mounted on the panel in the slots. The display hooks include front and rear rectangular mounting plates interconnected by a short narrow projection. The rear plate is somewhat thinner than the front plate and extends upwardly from the projection at a slight angle toward the front plate but above the front plate and forms a pad which extends generally parallel to the front plate. The lower end of the rear plate is spaced from the top of the projection slightly less than the width of the slot. Both plates are a width slightly less than the height of the slot. In this manner the hook is inserted by turning it on its side and inserting the top of the rear plate through the slot which springs away from the front plate. When the short projection engages the side of the slot the bottom of the rear plate snaps through the slot. The hook is then rotated to its upright position and slid downwardly until the short projection engages the bottom of the slot. Load moments on the hook do not produce any load moments on the edges of the slot which might be concentrated at the corners which would tend to tear the panel.

26 Claims, 2 Drawing Sheets

DISPLAY AND METHOD OF FORMING

DISCLOSURE

This invention relates generally as indicated to a display and method of forming, and more particularly to a point of purchase display for hanging packages or items from panel displays.

BACKGROUND OF THE INVENTION

A wide variety of retail displays have been proposed which use hook fixtures mounted in panels. A common form uses a plastic hook mounted in a horizontal or vertical slot in a panel such as cardboard. The panels, hooks and product may be prepackaged.

Examples of product displays using horizontal slots may be seen in U.S. Pat. Nos. 4,671,417 and 3,273,844. A display using a vertical slot may be seen in U.S. Pat. No. 3,252,678.

In U.S. Pat. No. 4,671,417 the hook is provided with a rear finger which closely conforms to the horizontal slot and hooks over the lower edge of the slot. The finger exerts a spring pressure against the back of the panel below the slot. A downward force on the forwardly projecting hook tends to pull the top of the finger forward and may tear the panel. Moreover, such a force tends to reduce the spring pressure of the finger against the back of the panel below the slot.

In the U.S. Pat. No. 3,273,844, while the hook back wall extends upwardly, the offset portion of the hook nonetheless closely conforms tot he slot and excessive downward pressure on the hook may tend to tear the panel at the corners of the slot. Moreover, the hook is difficult to insert.

In U.S. Pat. No. 3,252,678 the mounting end of the hook fits closely over the bottom end of a vertical slot. However, excessive force on the projecting hook may tend to tear the panel at the bottom corners of the slot.

It is therefore desirable that the hook be easy to insert yet not closely engage the edges or corners of the slot when inserted, nor exert a force moment which might tend to tear the panel at the corners of the slot. It is also desirable that the front or face plate of the mounting end of the hook obscure the die cut slot. It is also desirable that the spring pressure tending to hold the mounting end of the hook to the panel increase if a downward load is placed on the projecting hook.

SUMMARY OF THE INVENTION

A display for point of purchase items or packages includes a panel such as cardboard with one or more vertical rectangular slots with display hooks for supporting such items or packages mounted on the panel in the slots. The display hooks include front and rear rectangular mounting plates interconnected by a short narrow projection. The rear plate is somewhat thinner than the front plate and extends upwardly from the projection at a slight angle toward the front plate but above the front plate and forms a pad which extends generally parallel to the front plate. The lower end of the rear plate is spaced from the top of the projection slightly less than the width of the slot. Both plates are of a width slightly less than the height of the slot. In this manner the hook is inserted by turning it on its side and inserting the top of the rear plate through the slot which springs away from the front plate. When the short projection engages the side of the slot the bottom of the rear plate snaps through the slot. The hook is then rotated to its upright position and slid downwardly until the short projection engages the bottom of the slot. The slot is then concealed by the front plate. The lower edge of the front plate then is below the slot while the upper edge is above the slot. The spring loaded pressure pad at the upper end of the rear plate is also mostly above the slot and distributes the force over a large area. Accordingly load moments on the hook do not produce any load moments on the edges of the slot which might be concentrated at the corners which would tend to tear the panel.

To the accomplishment of the foregoing and related ends the invention, then, comprises the features hereinafter fully described and particulary pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
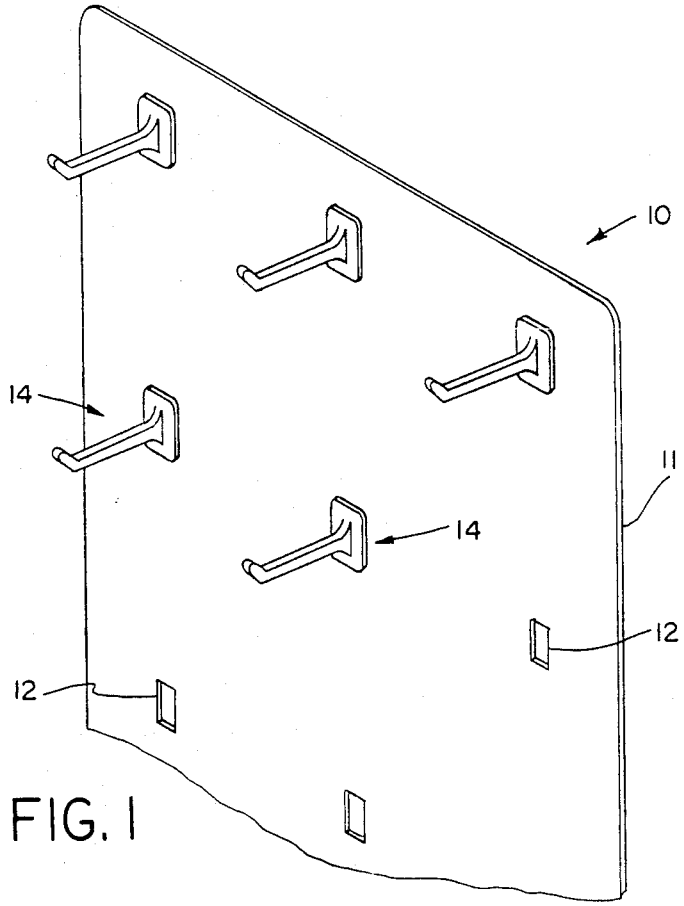
FIG. 1 is a fragmentary perspective of a display in accordance with the present invention.

Referring now to the annexed drawings and more particularly to FIG. 1 there is illustrated a display 10 in accordance with the present invention which comprises a panel 11 which is provided with a series of regularly spaced vertically elongated rectangular holes 12 in which are mounted display hooks 14. The panel may be cardboard, corrugated cardboard, or plastic, for example, and may be prepacked with the hooks assembled and the merchandise to be displayed mounted on such hooks, such merchandise being a wide variety of items which may be carded or packaged. The panel may include folded side panels, a rear easel strut, or other device to support the panel and the merchandise thus displayed in an upright position.

Figure 2:
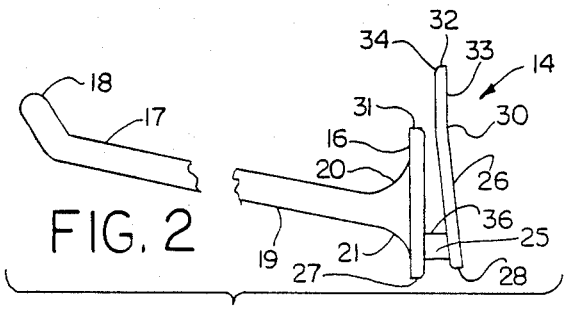
FIG. 2 is an enlarged side elevation of the display hook with the forwardly projecting hook broken away.
Figure 3:
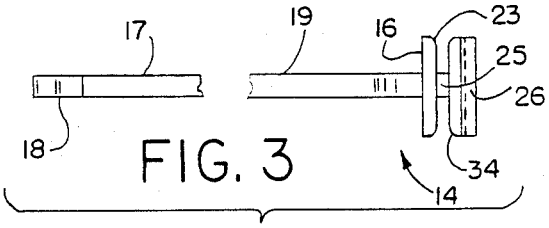
FIG. 3 is a view from the top of FIG. 2.
Figure 5:
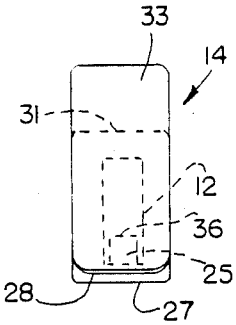
FIG. 5 is a view from the rear of FIG. 2 with the location of the panel slot shown in dotted lines.

Referring now to FIGS. 2, 3 and 5, it will be seen that the display hook 14 comprises a front or face plate 16 which is generally vertically elongated and rectangular but substantially larger than the configuration of the slot 12. Forwardly projecting hook 17 extends upwardly at a slight incline from the face plate and terminates in an upturned tip portion 18. The shank 19 of the hook portion is shown broken away since it will be appreciated that such shank may vary in length. Typical length examples would be 2, 4 and 6 inches. At the juncture of the shank with the front of the face plate there are provided two substantial radius gussets as seen at 20 and 21 above and below the hook shank respectively.

The inner or rear edges of the face plate 16 are radiused as indicated at 23 and near the bottom of the front or face plate there is provided a narrow short rearwardly extending projection 25 which is square in vertical section and which connects the front plate to rear plate 26. The projection 25 is spaced above the bottom edge 27 of the front plate. Such projection 25 is also spaced above the bottom edge 28 of the rear plate but to a lesser extent. The rear plate is slightly thinner than the front plate and extends upwardly from the projection at a slight angle to a vertical plane toward the rear of the front plate. At the point 30 which is substantially horizontally aligned with the top edge of the front plate the rear plate changes direction slightly to extend essentially parallel to the front plate. The rear plate continues to a higher elevation terminating at edge 32. Thus the top portion 33 of the rear plate at and aboove the end 30 forms a pressure pad of substantial area. The inner edges of the rear plate are radiused as indicated at 34.

It is noted that both the front and rear plates are rectangular and are of a common width. The rear plate however is higher than the front plate extending to the edge 32. Also, the lower edge 28 of the rear plate is above the lower edge 27 of the front plate. The width of the front and rear plates are substantially equal to the height of the slots 12 in the panel 11. Also, the distance from the top 36 of the short projection 25 to the lower edge 28 of the rear plate is equal to or slightly less than the horizontal width of such slots. Also, the diagonal dimension of the short projection 25 is slightly less than the width of the slots 12.

Figure 4:
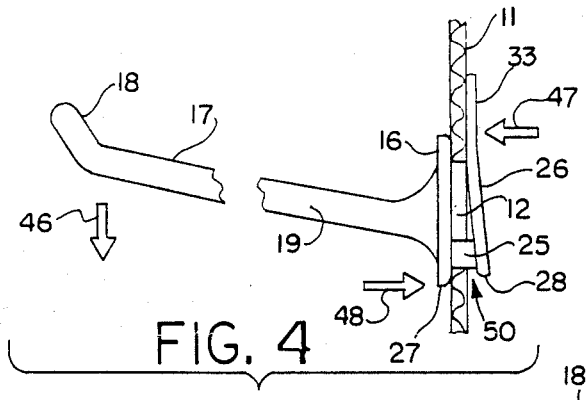
FIG. 4 is a view similar to FIG. 2 of the hook installed and also showing the location of resultant force moments under load.
Figure 7:
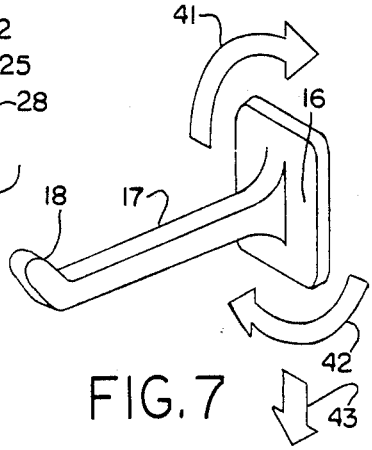
FIGS. 6 and 7 show the steps of assembly of the hook and panel.
Figure 6:
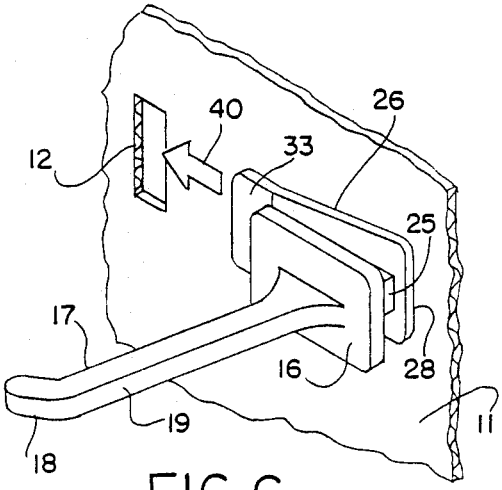

Referring now to FIGS. 6 and 7 there is illustrated the manner of installation of the display hook and panel. The hook 14 is initially turned on its side and the top projection 33 of the rear plate is inserted through the slot so that the projection is on the back of the panel. The display hook is moved in the horizontal direction shown by the arrow 40 until the lefthand side of the slot seen in FIG. 6 engages the short projection 25. When such projection engages the side of the slot, the bottom edge 28 of the rear plate will snap through the slot so that the rear plate is entirely on the back of the panel. During such insertion movement, the top of the rear plate including the projection 33 will spring away from the front plate gripping the panel as a clothespin. When the lower edge of the rear plate has passed through the slot the display hook is rotated 90° as seen by the arrows 41 and 42 in FIG. 7 to its upright position. Next, the display hook is moved downwardly as indicated by the arrow 43 until the projection 25 engages the bottom of the slot. This condition is seen in FIGS. 4 and 5. In such condition the front plate 16 completely obscures the slot and the projectioon 33 on the rear plate extends substantially above the slot holding the display hook in place with spring pressure.

Referring now to FIG. 4 it will be seen that downward force indicated by the arrow 46 on the hook or shank of the hook creates resultant force moments on the rear and front of the panel as indicated by the location of the arrows 47 and 48. The force on the rear of the panel as indicated by the arrow 47 is substantially above the slot and moreover is in the same direction as the force provided by the yielding nature of the upper portion of the rear plate. The force on the front of the panel is at the lower edge 27 of the front plate which is substantially below the slot.

Accordingly, with the present invention there is no significant force exerted on any edge of the slot and in fact at the lower edge of the slot there is a slight clearance as seen at 50. The display hooks of the present invention may readily be formed by injection molding with suitable plastics. For the longer shank hook the plastic material may be reinforced plastic.

It can now be seen that there is provided a display and a display hook therefor which is easy to assemble simply being turned on its side and slipped into the vertical slot and then rotated 90° and moved downwardly to be positioned properly. The large rear plate extending above the slot provides more pressure area to prevent wobbling or looseness and yet does not engage the slot or edges of the slot in a manner which could tear the panel either during assembly or loading or as the packaged or carded items are removed from the hook.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A display hook for insertion into a rectangular slot of a panel comprising a front plate, a forwardly projecting hook extending upwardly in slightly inclined fashion from said plate, a narrow short projection extending rearwardly from said front plate above the lower edge thereof and adapted to extend through such slot and connecting said front plate to a rear plate, said rear plate extending upwardly generally parallel to said front plate and including an upper portion adapted to bear against the rear of the panel above such slot.

2. A display hook as set forth in claim 1 wherein said front and rear plates are rectangular.

3. A display hook as set forth in claim 2 wherein said front plate completely covers such slot when said short projection is at the bottom of such slot.

4. A display hook as set forth in claim 2 wherein the lower edge of said rear plate is above the lower edge of said front plate.

5. A display hook as set forth in claim 2 wherein the width of said rear plate is less than the height of such slot.

6. A display hook as set forth in claim 2 wherein the distance between the bottom of said rear plate and the top of said short projection is less than the width of such slot.

7. A display hook as set forth in claim 2 wherein said rear plate extends upwardly at a slight angle toward said front plate.

8. A display hook as set forth in claim 7 wherein said rear plate includes a top portion extending at a slight rearward angle with respect to the rest of the rear plate.

9. A display hook as set forth in claim 8 wherein the lower end of said top portion of said rear plate is substantially horizontally even with the top edge of said front plate.

10. A display hook as set forth in claim 9 wherein said hook is formed of plastic and said rear plate is thinner than said front plate whereby the upper portion of said rear plate will spring away from said front plate when a panel is inserted therebetween with the upper portion bearing against the back of the panel under spring pressure.

11. A display including in combination a panel having a vertically elongated rectangular slot, a display hook mounted in said slot and including a front plate, a forwardly projecting hook adapted to support packages for display extending from said front plate, said front plate being adapted to bear against the front of said panel, a rearwardly extending short projection extending from said front plate through said slot and interconnecting said front plate to a rear plate, said rear plate extending upwardly from said short projection above said slot and including an upper portion spring loaded against the back of said panel above said slot.

12. A display as set forth in claim 11 wherein said front and rear plates are rectangular.

13. A display as set forth in claim 12 wherein said front plate completely covers said slot when said short projection is at the bottom of said slot.

14. A display as set forth in claim 12 wherein the lower edge of said rear plate is above the lower edge of said front plate.

15. A display as set forth in claim 12 wherein the width of said rear plate is less than the height of said slot.

16. A display as set forth in claim 12 wherein the distance between the bottom of said rear plate and the top of said short projection is less than the width of said slot.

17. A display as set forth in claim 12 wherein said rear plate extends upwardly at a slight angle toward said front plate.

18. A display as set forth in claim 17 wherein said rear plate includes a top portion extending at a slight rearward angle with respect to the rest of the rear plate.

19. A display as set forth in claim 18 wherein the lower end of said top portion of said rear plate is substantially horizontally even with the top edge of said front plate.

20. A display as set forth in claim 19 wherein said hook is formed of plastic and said rear plate is thinner than said front plate whereby the upper portion of said rear plate will spring away from said front plate when said panel is inserted therebetween with the upper portion bearing against the back of said panel under spring pressure.

21. A method of forming a display comprising the steps of forming a vertically extending rectangular slot in a panel, providing a display hook which includes front and rear rectangular mounting plates interconnected by a short projection near the lower ends thereof with the rear plate extending upwardly beyond the front plate and including a spring loaded pressure pad projecting end, turning the display hook on its side and inserting the projecting end of said rear plate through said slot until said short projection engages the side of the slot at which point the entire rear plate snaps through such slot to be on the rear of the panel, and then rotating the display hook 90°.

22. A method as set forth in claim 21 including the step of then moving the hook downwardly until the short projection engages the bottom of the slot.

23. A method as set forth in claim 22 wherein such front and rear plates are rectangular.

24. A method as set forth in claim 22 wherein the width of said rear plate is less than the height of such slot.

25. A method as set forth in claim 22 wherein the lower edge of said rear plate is above the lower edge of said front plate.

26. A method as set forth in claim 22 wherein the distance between the bottom of such rear plate and the top of such short projection is less than the width of such slot.

* * * * *